US005350178A

United States Patent [19]

Hollar

[11] Patent Number: 5,350,178

[45] Date of Patent: Sep. 27, 1994

[54] CAR RACING GAME

[76] Inventor: A. Keith Hollar, 3333 Tryon Courthouse Rd., Cherryville, N.C. 28021

[21] Appl. No.: 53,181

[22] Filed: Apr. 26, 1993

[51] Int. Cl.[5] ..... A63F 3/00

[52] U.S. Cl. ..... 273/246; 273/286

[58] Field of Search ..... 273/242, 243, 246, 248, 273/249, 286

[56] References Cited

U.S. PATENT DOCUMENTS

| | | | |
|---|---|---|---|
| 1,797,742 | 3/1931 | Ward | 273/246 |
| 3,690,666 | 9/1972 | Seitz | 273/246 |
| 4,252,324 | 2/1981 | Simonw | 273/286 |
| 4,624,463 | 11/1986 | Glennon | 273/246 |
| 4,673,184 | 6/1987 | Sansores | 273/286 |
| 4,850,597 | 7/1989 | Milliken | 273/286 X |
| 4,890,842 | 1/1990 | Plange | 273/246 |
| 4,917,386 | 4/1990 | Tozer | 273/286 X |
| 5,092,605 | 3/1992 | Hoffman | 273/246 |
| 5,114,152 | 5/1992 | Rouse et al. | 273/246 |
| 5,139,267 | 8/1992 | Trevisan | 273/246 |

FOREIGN PATENT DOCUMENTS

| | | | |
|---|---|---|---|
| 1501915 | 10/1967 | France | 273/286 |
| 1417646 | 12/1975 | United Kingdom | 273/246 |

*Primary Examiner*—William Stoll
*Attorney, Agent, or Firm*—Judith E. Garmon

[57] ABSTRACT

A board game simulating an automobile race for one or more players includes a flexible game board with a first race track depicted on one side and a second, generally smaller, track on the opposite side. A textured track surface on preferred embodiments enables playing cars to remain in place if the flexible game board is placed on uneven or banked support surfaces to simulate real-life tracks. A plurality of charts determine the course and type of movement along either track, responsive to the roll of one or more dice, each die being of a distinct color to indicate a specific chart. Novel rules for playing require decision making and strategy, thus creating a realistic environment of racing, changing with each play of the game.

6 Claims, 9 Drawing Sheets

GAME INSTRUCTIONS

CONGRATULATIONS

You've just opened the best simulated stock car race game to date. Just as in real racing this game requires both luck and strategy to win.

OBJECTIVE:

The object of the game is to be the first driver to complete the number of determined laps and cross the finish line. (A race can consist of any number of counter clockwise laps. We recommend 5 for a 6 cylinder race and 10 for an 8 cylinder race).

BASIC GAME:

(Recommended for ages 6 - 9)

In this game a person may play alone by rolling the dice for two or more cars, or compete with friends. The object is the same as above and is accomplished by each rolling the dice and simply adding the number of dots together (ie: ⚀ + ⚃ = 5 spaces for that car).

ADVANCED GAME:

(Recommended for ages 10 - adult)

The advanced version may also be played alone or with friends. It requires the cross referencing of charts, score keeping, and the use of strategy which can actually teach some of the elements involved in real stock car racing. *(For consistency and realism -- we will refer to the PLAYER/S as DRIVER/S and the GAME as the RACE throughout the instructions).*

QUALIFYING:

(Determining the starting positions of each driver's car prior to the race's start).

OPTION — 1: (For races involving 5 or fewer cars). Referring to the Qualifying Chart (Chart-C, enclosed). Each driver will roll one die placing their car in the position indicated. If two or more drivers roll the same number, they must then roll one die until the one with the lowest number wins the pole position. This is repeated until all cars are positioned at the Starting Line as in a real race.

OPTION — 2 (For races involving 6 or more cars). Each driver will roll two dice (remembering their number). The lowest number rolled will place that driver on the pole (first position). The highest number rolled will place that driver at the rear of the field (last position). If two drivers roll the same number each should roll a single die and the one with the lowest number take the position with the other lining up in the next position. NOTE; Once these positions have been established continue in this order throughout the race unless someone is declared out. Record the starting order on the RACE STAT SHEET. This sheet will help keep up with laps, lap leaders, pitting, points, and other data.

Figure 5A

TO BEGIN:

The race starts and re-starts by the drivers rolling both dice and referring to the START/RE-START Chart (Chart-A, enclosed). As in a real race, the driver sitting on the pole goes first and each follows in turn until all have completed their first turn. (Remember that one color die is to be read in tens and the other in ones; ie: ⚁ + ⚂ = 23). After each as completed the first turn, the drivers will roll the dice and refer to the BASIC RACE Chart (Chart-B, enclosed) until CAUTION is declared on the track.

The realism and excitement should build as each driver will now refer to the BASIC RACE CHART when rolling the dice. See Example 1:

Example 1:
A driver rolls a ⚁ + ⚅ =36 and refers to Chart-B #36. . . beside #36 is +7. . . that driver will move forward seven spaces.

The fun and sometimes frustration of real racing comes to life when a driver is directed from Chart-B to the SPECIAL ROLL CHART (Chart-C, enclosed). See Example 2 below:

Example 2:
A driver rolls a ⚁ + ⚅ =34 and refers to Chart-B #34. . . beside #34 it says: SPIN CHART. . . he/she then rolls on a ⚀ on one die and refers to the SPIN CHART. . . beside #1 it says: HIT WALL/CRASH (*) . . . referring to the CRASH CHART the driver rolls a ⚅. . . beside #6 under CRASH it says: Pit/Sheet Metal Damage. That driver places his/her car in the Pit Area immediately and CAUTION is declared on the track!

MOVING:

Cars are moved around the track "counter clockwise" according to the number of spaces or directions during a driver's turn (See Ex. 2 above). Each space advanced counts as one as well as each space moved laterally/lane change.

PASSING:

When a driver's lane is blocked by another car, he/she may move to the right or left (changing lanes) to complete the pass. Each lateral move will also count as one space. If a driver approaches a group of cars during the move and cannot pass. . . the boxed in driver must forfeit the remainder of the move and just as in a real race. . . hit the brakes !!!

PITTING:

When a driver is directed to PIT he/she must enter Pit Row as soon as possible. Once on Pit Row he/she will (on their next turn) roll one die and proceed the number of spaces indicated (they will repeat this on each consecutive turn until they have reached their Pit area). If a driver has been in a CRASH, a CAUTION is declared on the track and he/she will place their car in the Pit area immediately while the others will sort out the restart. (See CAUTION section Chart-C). After reaching the Pit the driver will on the next turn roll one die and refer to the PIT CHART, (Chart-C) for instructions. If the driver is held in the Pit he/she will be allowed to roll one die on their next turn and proceed the number of spaces indicated. This will be repeated on each turn until the driver exits Pit Row and returns to the track. NOTE; As the car exits Pit Row and returns to the track it will cross the stripe at the end of Pit Row and should be rewarded a lap.

Figure 5B

START/RESTART RACING
*CHART - A (USE TWO DICE)*

| | | | |
|---|---|---|---|
| 11 | +1 | 41 | +10 |
| 12 | +1 | 42 | +10 |
| 13 | +2 | 43 | +11 |
| 14 | +2 | 44 | +11 |
| 15 | +3 | 45 | +12 |
| 16 | +3 | 46 | +12 |
| 21 | +4 | 51 | +13 |
| 22 | +4 | 52 | +13 |
| 23 | +5 | 53 | +14 |
| 24 | +5 | 54 | +14 |
| 25 | +6 | 55 | +15 |
| 26 | +6 | 56 | +15 |
| 31 | +7 | 61 | +16 |
| 32 | +7 | 62 | +16 |
| 33 | +8 | 63 | +17 |
| 34 | +8 | 64 | +17 |
| 35 | +9 | 65 | +18 |
| 36 | +9 | 66 | Perfect Set Up Chart |

Figure 6

BASIC RACING

*CHART - B (USE TWO DICE)*

| | | | |
|---|---|---|---|
| 11 | Pit | 41 | Black Flag Chart |
| 12 | +2 | 42 | +8 |
| 13 | +2 | 43 | +8 |
| 14 | Draft Up To Next Car or +3 | 44 | Draft Up to Next Car or+9 |
| 15 | +3 | 45 | +9 |
| 16 | +3 | 46 | +9 |
| 21 | Fuel Chart | 51 | Fuel Chart |
| 22 | +4 | 52 | +10 |
| 23 | +4 | 53 | +10 |
| 24 | Tire Chart | 54 | Tire Chart |
| 25 | +5 | 55 | +11 |
| 26 | +5 | 56 | +11 |
| 31 | Pass Nearest Car | 61 | Pass Nearest Car or +11 |
| 32 | +6 | 62 | +12 |
| 33 | Perfect Set Up Chart | 63 | +12 |
| 34 | Spin Chart | 64 | Spin Chart |
| 35 | +7 | 65 | Pass next Two Cars or +14 |
| 36 | +7 | 66 | Perfect Set Up Chart |

Figure 7

SPECIAL ROLL CHART-C
(Use One Die)

100

SPIN

1 Hit Wall - Crash (*)
2 Save - Scrape wall +1
3 Crash (*)
4 Save +3
5 Save - Rub Only +4
6 Save +5

102

CRASH

1 TOW BEHIND WALL (*)
2 Pit - Loose a turn
3 Tires (*)
4 Pit - Body Damage
5 Scrape Wall /Rub (*)
6 Pit - Sheet Metal Damage

DRIVE THROUGH CRASH

1 Crash (*)
2 O.K. +2
3 Rub (*)
4 O.K. +4
5 Scrape Wall +1
6 O.K. +6

108

RUB

1 Spin (*)
2 O.K. +2
3 Spin (*)
4 O.K. +4
5 O.K. +5
6 O.K. +6

PIT

1 Speeding - Lose a turn
2 Fuel & 4 tires +2
3 Engine/Lose a Turn
4 Fuel & 2 Tires +4
5 Air Wrench Broke +0
6 Fuel Only +10

BEHIND WALL

1 Out of Race-
2 Pit -Lose a Lap
3 Pit -Lose a Turn
4 Pit
5 Pit
6 Pit

FUEL

1 Out - Pit
2 Pressure Drop +1
3 Low - Pit
4 Gauge Malfunction +4
5 Pressure Drop +3
6 Gauge Malfunction +5

TIRES

1 Blow-Out / Spin (*) +0
2 Cut Pit +1
3 Blow-Out / Spin (*)
4 Rubbing / Pit +2
5 O.K. +3
6 O.K. +5

PERFECT SET-UP

1 +20
2 +21
3 +22
4 +23
5 +24
6 +25 or go to front

QUALIFYING

1 Pole Position!
2 2nd
3 3rd
4 4th
5 5th
6 Crash/Start Rear

BLACK FLAG

1 Bad Sportsmanship - 1 Lap
2 Pit
3 Fluid Leak/Pit
4 Pit
5 Tire Smoke/Pit
6 Pit

RESTART

1 Extra Lap
2 Extra Lap
3 Extra Lap
4 Restart
5 Restart
6 Restart

Note: (*) Means to refer to another chart on this page.

CAUTION is declared on the track for all crashes. All cars on the track OR on Pit row (HAVING COMPLETED THEIR PIT STOP), are lined up in order for a "single" file restart. If one or more cars are a lap or more down these will start to the left of the leader (on inside lane) at the Starting Line. The driver who caused the Caution will roll a die referring to the Restart Chart on this page to determine how many laps (if any) will be added to the ONE AUTOMATIC LAP. (Don't forget to check off each lap on the RACE STAT SHEET).

Figure 8

RACE STAT SHEET

TRACK: _____ (SPEEDWAY) [ ] 5 Laps [ ] 10 Laps

DATE: ____/____/____

| DRIVERS | CAR # | 1 | 2 | 3 | 4 | 5 | 6 | 7 | 8 | 9 | 10 |
|---|---|---|---|---|---|---|---|---|---|---|---|
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |
| | | | | | | | | | | | |

OTHER NOTES:

TO KEEP UP WITH EACH DRIVER'S PROGRESS. . . place a check in the center of the block for that lap. If a driver is ordered to Pit place a small "p" in the lower corner of the next lap block. If a driver crashes place a "c" in a corner of that lap block. If a driver leads a lap place a * in a corner of that block etc.

NOTE: * indicates Lap Leader, P indicates Pit, C indicates Crash

| RACE RESULTS: | | PURSE: | POINTS: |
|---|---|---|---|
| 1st Place | _____ | $ _____ | _____ |
| 2nd Place | _____ | $ _____ | _____ |
| 3rd Place | _____ | $ _____ | _____ |
| 4th Place | _____ | $ _____ | _____ |

Figure 9

CAR RACING GAME

Background

This invention relates to a simulated stockcar race game which requires both strategic skill and luck to win.

Previous car racing games have been patented, as U.S. Pat. No. 4,890,842, Plange, which is a Rallye car race, wherein players travel around a game route which depicts the U.S., Canada, and Mexico on a gameboard. Chance cards, pawns, and pegs are used to score points for winning.

Hoffman's U.S. Pat. No. 5,092,605 also teaches a racing game in which points are accumulated to win the game.

U.S. Pat. No. 5,139,267 incorporates a racing board game that uses questions about NASCAR racing as a means of advancing on one of the board's two tracks.

Charles R. Simon secured a patent for a flexible gameboard and carrying case in his U.S. Pat. No. 4,252,324. A seating surface/gameboard device is described in U.S. Pat. No. 4,673,183 by Sansores. As is evidenced by the aforementioned games, there are any number of racing board games. However, the present invention, with its unique playing surface, which happens to be reversible to provide varying tracks, capture as no other game has done, a simulated stockcar race through its rules that requires strategy and skill as in an actual race, coupled with luck.

The game is played on a reversible game board with a choice of "race tracks". One side has a diagram of a major NASCAR track, such as Charlotte Motor Speedway or Daytona; while the second, opposite side of the game board has at least one diagram of a smaller race track such as Watkins Glen. This affords the player/-racers a variety of tracks on which to race. The playing pieces for the game are small scale reproductions of race cars.

Realism and excitement result from a unique combination of game components including a plurality of instructional charts, stat sheets, and chance means such as dice. The instructional charts not only provide specific instructions but also include data from which a player must select a move, thus introducing skill and strategy into the play.

While many race games are much the same each time they are played and depend only on chance progression around a track, the present invention changes with each race and therefore seems new with each play. It is also a game suitable for one player, if desired; the one player controlling two or more of the playing cars.

It is therefore an object of the invention to provide an automobile racing game which will simulate as nearly as possible an actual NASCAR or other stock car race. Other forms of racing may be featured by changing the schematics for the track, the scale model cars and amending selected materials on the instructional charts.

A better understanding of the invention will be achieved by a review of the following detailed description in conjunction with the accompanying drawings. In the drawings:

FIGS. 5A and 5B are charts defining rules for play;

FIGS. 6–8 are samples of instructional charts used during play; and

FIG. 9 is an example of one form of stat sheet used during play to track a player's position in the race.

DETAILED DESCRIPTION OF A PREFERRED EMBODIMENT

Figure 1:
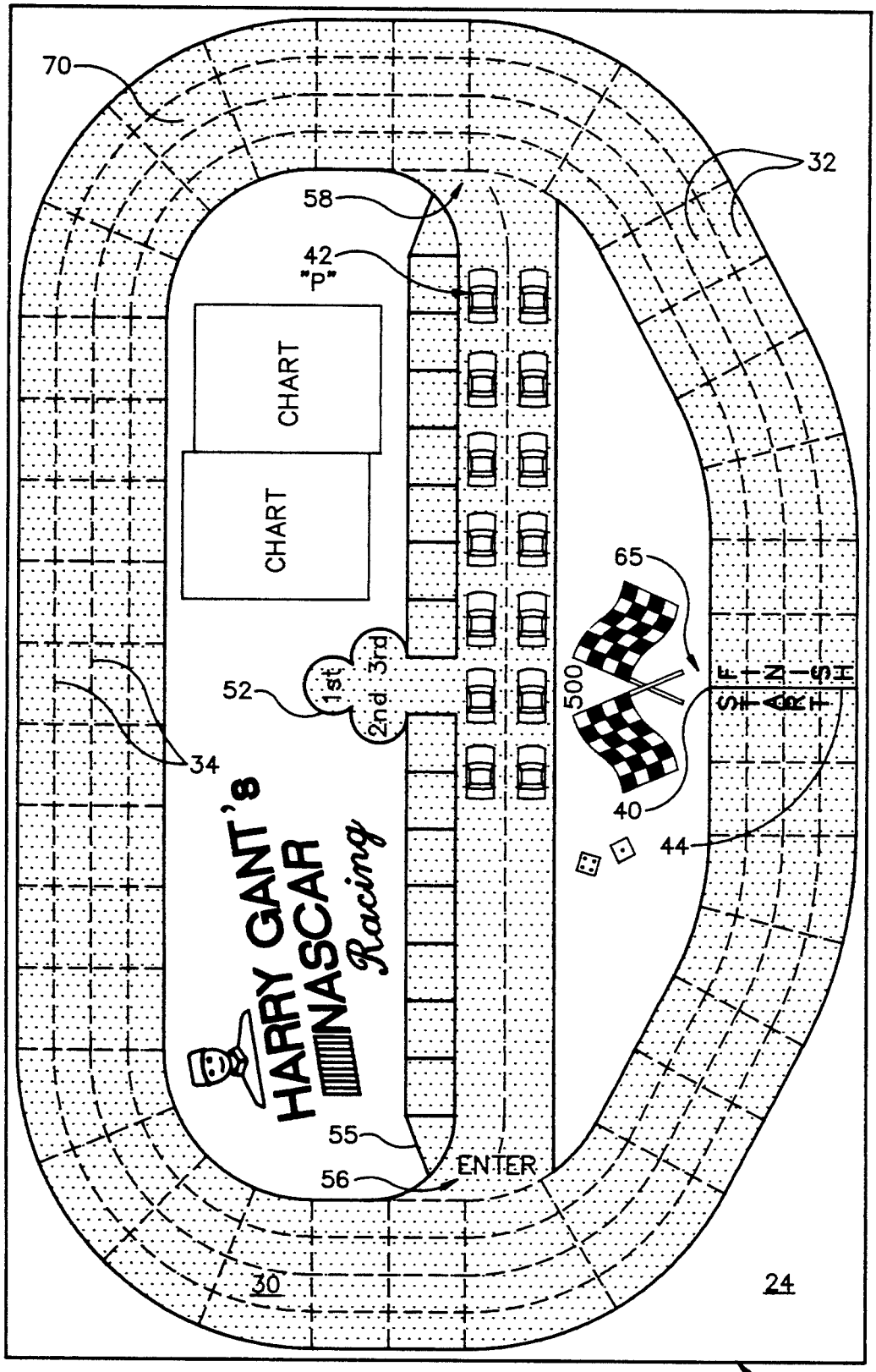
FIG. 1 is a plan view of one embodiment of the flexible playing surface, with a depiction of a major, identifiable racetrack thereon.
Figure 2:
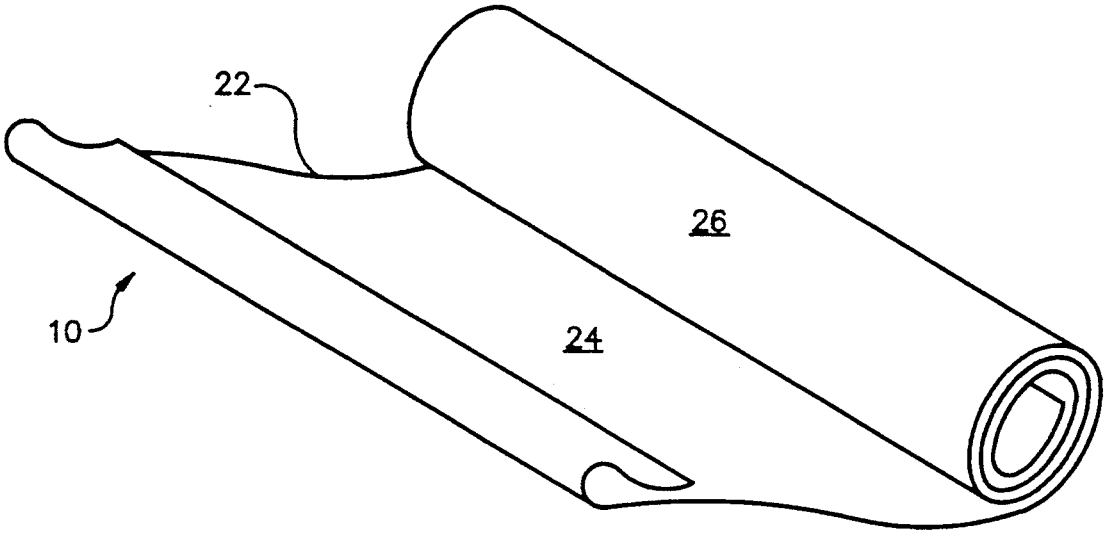
FIG. 2 is a view of the flexible playing surface, without printed indicia thereon.
Figure 3:
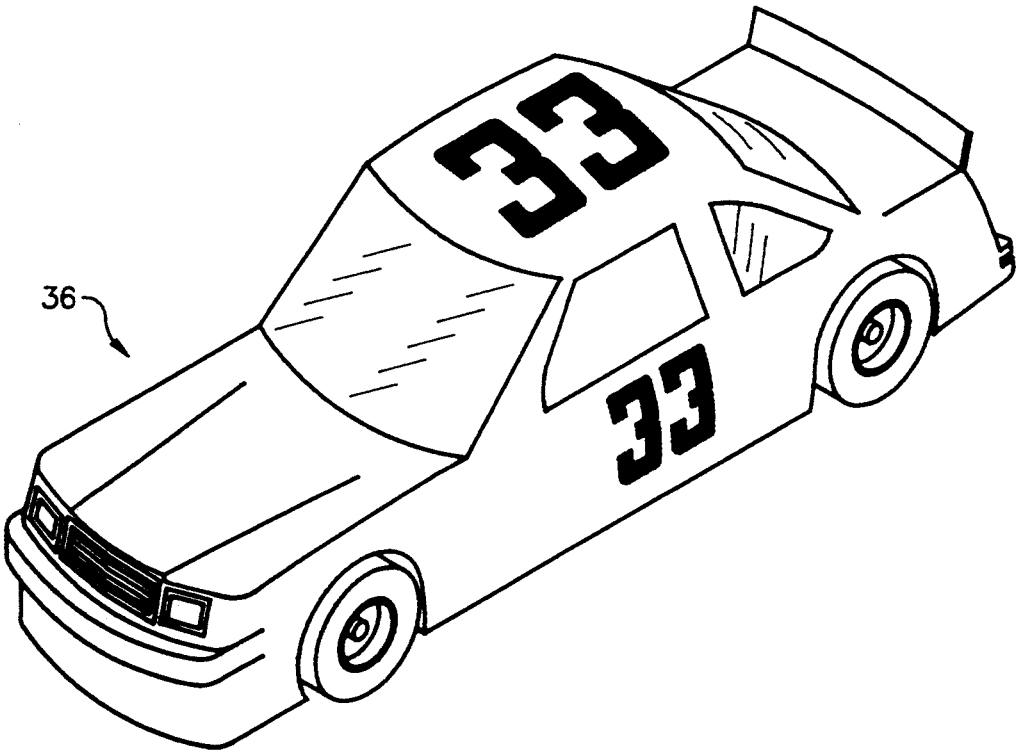
FIG. 3 is a perspective view of an example of one of the scale model cars used in play.
Figure 4:
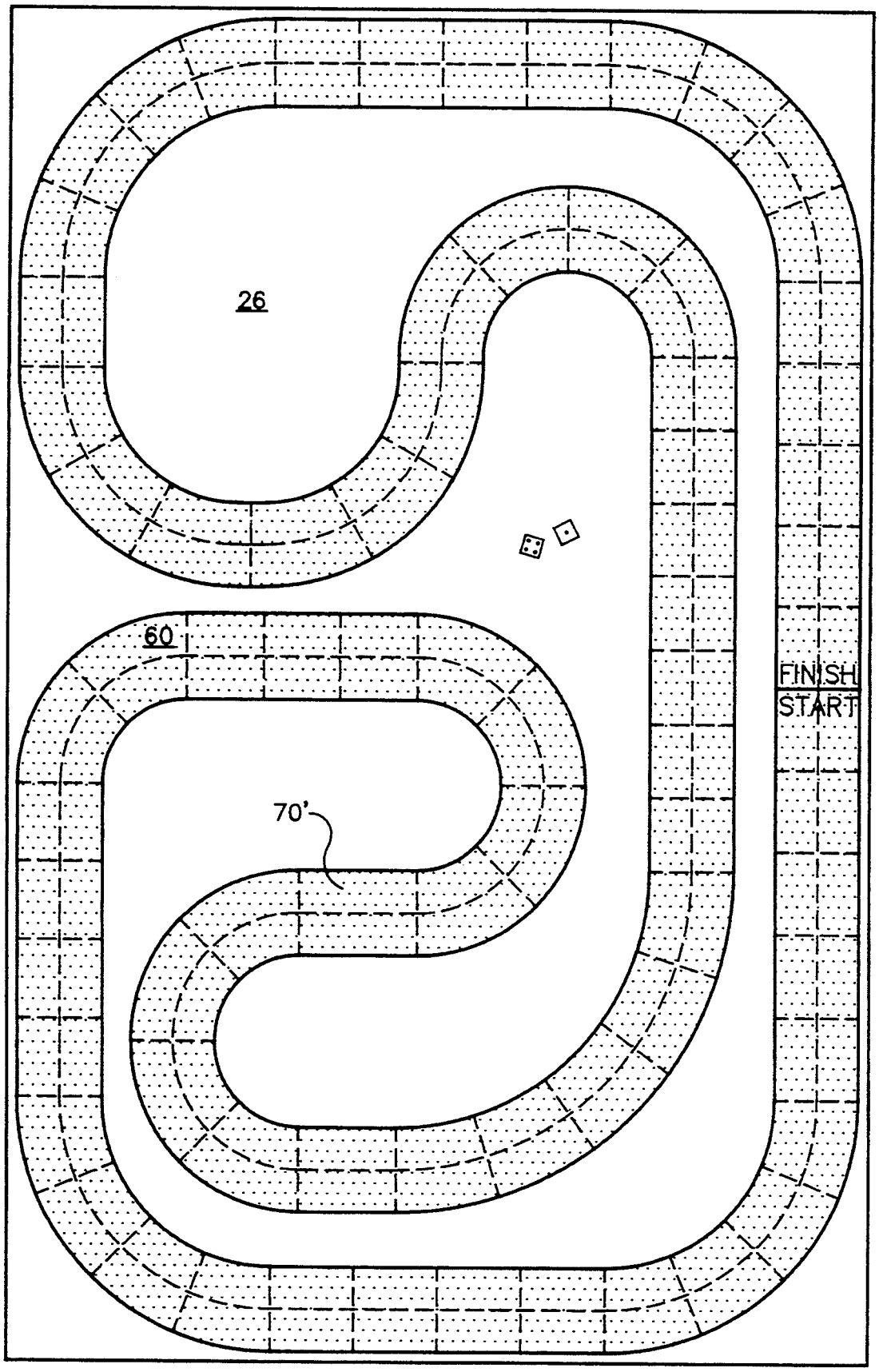
FIG. 4 is a plan view of an alternate track on the reverse side of the flexible playing surface.

Looking first at FIGS. 1 and 2 a preferred embodiment of the preferred playing surfaces for the auto racing game 10 is shown. The playing board 20 as shown is a web or sheet 22 of a flexible material having substantive weight, durability, and tear resistance. A preferred material is one of the heavier vinyl materials provided in sheet form, and in addition to the above characteristics has the quality of being receptive to various printing media such as inks and dyes. The playing board 20 includes a first face 24 having a first playing surface printed thereon; and an oppositely disposed second face 26 having a second playing surface printed thereon. The first playing surface depicted on face 24 preferably is a representation of a major automobile racing track such as NASCAR's Charlotte Motor Speedway or Daytona. While a printed diagram of such a race track may be utilized, it is also anticipated that in some embodiments of the present invention it will be desirable to reprint an aerial photograph of a selected track onto the playing board. In the present description the depiction of track 30 is diagrammatic. The continuous track 30 is divided into a plurality of contiguous lanes 32, and each lane 32 is divided into a plurality of segments or spaces 34. Using scale model cars 36 as playing tokens, players advance along these lanes from segment to segment, and may cross into and out of one or more lanes, as they circle the track a prescribed number of laps. Play commences (as described below) from a starting line 40 at the pole position 42, and is completed at finish line 44 after passage of the prescribed number of laps.

"Victory lane" and the "winner's circle" are depicted at 50 and 52 respectively. Pit row 55 is positioned in the infield area of the track with entry at 56 and exit back onto the track at 58. Area 65 denotes a signal area where "caution" and other signal flags are utilized to warn drivers/players of prevailing conditions on the track.

The reverse side or second face 26 of the playing board may be left blank, but preferably includes a smaller track 60 depicted thereon. An example of one such track is Watkins Glen, in New York. The smaller track 60 may be utilized for shorter and/or simpler games; perhaps for younger players where dice are thrown and cars are moved ahead according to the number thrown and the race is won simply by the car first to reach the finish line. Obviously, however, the more advanced rules disclosed below may be used on either track for a more stimulating race.

The flexibility of the playing board, in addition to enabling a large playing surface to be folded or rolled for storage in a small package, also permits a certain amount of realism to be injected into play. This is accomplished by placing the flexible sheet 22 over a table or board having an irregular surface configuration, such that the track appears to be banked on certain turns, or if a cross-country type of race, the surface configuration may include hills, sharply banked curves, and the like. It is anticipated that in larger editions of the game, the track may be drawn to scale and, by manipulation of flexible sheet 22, made to overlie a supporting surface that is configured, much like natural terrain.

Toward this same goal of realism, the tracks 30 and 60 preferably include some type of surface texture which improves the perception of traction or grip of the cars 36 on the track. On preferred embodiments the textured areas 70,70' of the tracks are coated with a material similar to an acrylic paint or coating which includes a grit or granular material therein to create a stippled or grainy surface. The effect of the coating is to create a flexible, somewhat tacky, but non-sticky, surface on which the cars 36 will remain in place if the playing surface is banked or rests on other than a perfectly flat surface.

In less expensive embodiments the texturing, at 70 and 70' may be more of a visual effect created by particular applications of color and shading to create a realistic appearance only.

Play, in the preferred embodiments, proceeds according to the rules for the advanced game illustrated in FIGS. 5A and 5B. Depending upon the number of players participating, Option 1 or Option 2 as described in FIG. 5A is selected for determining the starting positions for the cars in the race. Just as in a real race, each player/driver is hoping to qualify for the pole position, shown, in FIG. 1 at "P". The cars move counterclockwise on the track. Using one die (if under five players) each player rolls the die and his/her car is placed in the position corresponding to the number rolled. For more than five player/drivers two dice are used and the numbers on each are added together. The player/driver with the lowest number rolled gets the pole "P" position, and with the highest number is placed at the rear of the field in last position. These starting positions are recorded on the Stat Sheet shown in FIG. 9.

It should be noted that a die of one first color is to be read in multiples of 10s, and a die of a second, different color is read in 1s. For example, if a first red die turns a five, it is read as fifty, and the second blue die reads a three, for a total of fifty-three.

To begin the race after qualifying positions are determined, the player/drivers in turn roll both dice, add the numbers rolled together and, using that total, refer to the Start/Restart Chart of FIG. 6. If the player/driver rolls a twenty-one, he/she refers to Start/Restart Chart A, FIG. 6, and sees that for rolling twenty-one, he/she moves forward four spaces. For rolling fifty-three, move ahead fourteen spaces, etc.

After the first turn, player/drivers refer to the Basic Racing Chart B, FIG. 7 for instructions for movement. Cars move around the track according to the number of spaces or directions during a turn. Each space advanced counts as one spaced moved, as does one space moved laterally as in a lane change. For example, if a player/-driver rolls a thirty-four, refers to Chart B, he/she is referred to the "Spin" segment 100 of Chart C in FIG. 8. He/she then rolls only one die to get the numerical value to be used for instruction. If a one is rolled the car has "hit wall—crash". That player/driver must then refer to the "crash" segment 102 of Chart C, roll one die again, and follow the instructions for the rolled number. If a two, the car must move to the pit area of the track and loose a turn.

When a player/driver is sent to the Pit Row area, he/she remains there, proceeding a given number of spaces with each turn rolled, until reaching the Pit. After reaching the Pit, the player rolls one die on each consecutive turn and uses the "Pit" segment 108 of Chart C for instructions.

If a driver has been in a crash, a caution is declared on the track and he/she places the car in the Pit area immediately and the remaining players proceed through a Restart period using the previously described rules.

It is recognized that other and further modifications may be made while remaining within the scope of the claims below.

I claim:

1. A board game simulating an automobile race for one or multiple players; said board game comprising:

A. a game board formed of a sheet of selected flexible material, of a predetermined size, and having a first face on one side thereof and a second face on the opposite side thereof;

B. on said first face a playing surface comprised of a first printed depiction of a known, existing race track, said playing surface having a plurality of defined regions and a plurality of contiguous lanes representing a path of player travel, each of said lanes being divided into a plurality of distinct spaces;

C. a plurality of token cars for demonstrating player advancement along said race track;

D. a plurality of charts for determining the course and type of movement along said race track; each of said charts including defined categories of movement and enumerated instructions within each of said categories;

E. a plurality of dice to enumerate movement along said lanes and to indicate a referenced instruction on a selected one of said charts according to the rules of play; at least one of said die being of a first color, and a second one being of a second, different color;

F. texturing means for increasing the definition of distinct areas and lanes on said race track for enabling the positioning of said token cars on a selected area of said race track;

whereby one or more players play an auto racing game which, by use of rules which require decision making and strategy, coupled with chance, actually teaches some of the elements involved in auto racing.

2. A board game according to claim 1 wherein said flexible material which forms said game board is a selected sheet vinyl having the characteristics of flexibility, receptivity to a variety of printing media and methods, tear resistance, and durability.

3. A board game according to claim 2 wherein said selected sheet vinyl material has a thickness in a range equivalent to four to eight mil.

4. A board game according to claim 1 and further including said second face of said game board having a second printed depiction of a known, existing race track differing from the track depicted on said first face, whereby players may select either said first or second face for a given game.

5. A board game according to claim 1 wherein said token cars are comprised of scale model versions of existing race cars of a prescribed type.

6. A board game according to claim 1 wherein said texturing means comprises said lanes of said track having a coating applied thereto and said coating made from a selected coating material which, when cured, results in a surface having the characteristics of flexibility and an ability to create traction between said playing surface and said token cars, to prevent said cars from slipping out of a given position during play.

* * * * *